United States Patent [19]

Hanchett, Jr.

[11] 4,026,589

[45] May 31, 1977

[54] DOOR LOCKING MECHANISM

[76] Inventor: Leland J. Hanchett, Jr., 211 Ridge St., Winchester, Mass. 01890

[22] Filed: June 4, 1976

[21] Appl. No.: 692,833

[52] U.S. Cl. ..... 292/341.16; 292/DIG. 49

[51] Int. Cl.[2] ..... E05C 3/14

[58] Field of Search ..... 292/216, 341.17, 341.16, 292/78, 79, 201, DIG. 49

[56] References Cited

UNITED STATES PATENTS

| | | | |
|---|---|---|---|
| 3,638,984 | 2/1972 | Davidson | 292/341.16 |
| 3,819,215 | 6/1974 | Fuss | 292/341.16 |
| 3,822,904 | 7/1974 | Peterson | 292/78 |

*Primary Examiner*—Richard E. Moore

*Attorney, Agent, or Firm*—Erwin Salzer

[57] ABSTRACT

A door lock has both its dead bolt and spring latch released by the action of a single keeper. The keeper has two stable limit positions, i.e. it opens the strike case, or it closes the strike case. The keeper is held in its open position allowing the door to be opened and closed if the solenoid of the keeper was energized and if the dead bolt was in extended position at the time the door was opened. If the solenoid of the keeper is deenergized and if only the spring latch was extended, the keeper returns to locked condition once the latch bolt has cleared the strike, because the keeper is still biased to its second stable or closed position. In that position the keeper is then locked by the bias spring inside the keeper acting on the latch bolt.

7 Claims, 7 Drawing Figures

DOOR LOCKING MECHANISM

BACKGROUND OF THE INVENTION

This invention is applicable to locks which have only a dead bolt as well as to locks having a dead bolt and a spring latch, or a spring latch only. In all instances a single strike case is needed. Both dead bolt and spring latch are released by the action of a single keeper.

The keeper returns automatically to locked condition when the dead bolt reenters the strike case. The door may be closed with dead bolt extended.

The keeper is held open after the door is opened if the dead bolt was in extended position at the time the door was opened. If only the spring latch is extended but not the dead bolt, the keeper returns to locked condition once the latch has cleared the strike.

SUMMARY OF THE INVENTION

In its simplest embodiment the strike case is merely adapted to receive a dead bolt. A pivoted keeper is provided for selectively opening and closing said strike case. The keeper is under the action of bistable spring means acting on the keeper to maintain the keeper either in the fully open position, or in the fully closed position thereof. Said bistable spring means maintains said keeper in said fully open position, if said dead bolt is extended when the door is opened. The lock further includes a latch bolt for maintaining said keeper in said fully closed position thereof when said bistable spring means has moved said keeper to closed position.

DESCRIPTION OF PREFERRED EMBODIMENTS

Figure 1:
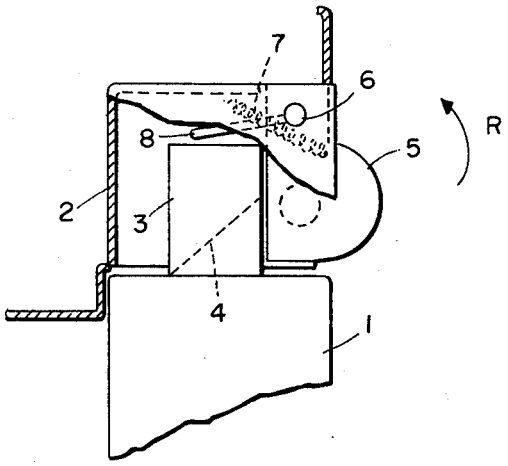
FIG. 1 is a top plan view of the complete lock in the closed and latched position of its keeper.

Referring now to the drawings, numeral 1 has been applied to indicate a door and numeral 2 has been applied to indicate a strike case. A dead bolt 3 is movable into and out of strike case 2. The dead bolt 3 has an extended position and a retracted position, and FIG. 1 of the drawing shows the dead bolt in its first mentioned position. Reference numeral 4 has been applied to indicate a spring latch bolt. The presence of such a bolt is optional rather than mandatory. Reference numeral 5 has been applied to indicate the housing of a keeper pivotable about a pair of pins 6. In the position shown in FIG. 1 the keeper is in closed position and a latch bolt thereof engages a recess in the strike case. A return spring 7 tends to maintain the keeper 5 in the position shown. When the solenoid inside keeper 5 is energized, the latch bolt leaves the aforementioned recess in strike case 2 and then keeper 5 can be pivoted in counter-clockwise direction as indicated by the arrow R. Reference numeral 8 has been applied to indicate a substantially U-shaped spring that forms an abutment cooperating with dead bolt 3.

Figure 2:
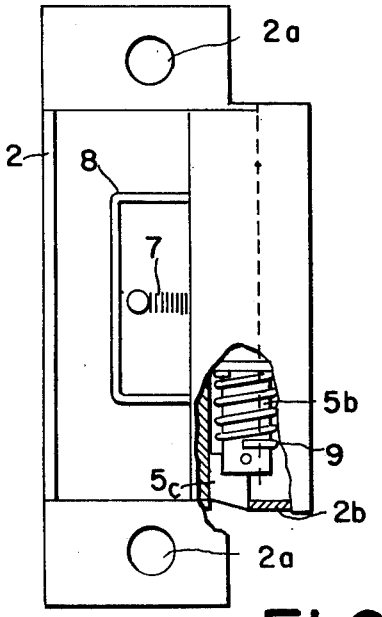
FIG. 2 is an elevational view of the lock of FIG. 1 with the dead bolt and the spring latch removed in order to expose to full view the striker case and the parts of the keeper inside of the striker case.

Referring now to FIG. 2, this figure shows the strike case 2 having two apertures **2*a* for affixing it to the door jam. Inside the strike case 2 the aforementioned return spring 7 and abutment 8 are visible. The keeper 5 houses the solenoid 5*a* (see FIG. 3), its plunger 5*b*, and the bias spring 9 supports latch bolt 5*c*. With the keeper 5 in the closed position, latch bolt 5*c* engages projections 2*b* in strike case 2 as a result of the extension of bias spring 9**.

Figure 3:
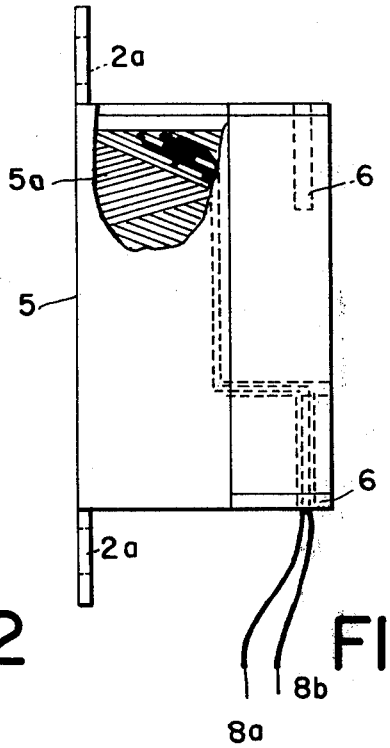
FIG. 3 is a side elevation of the keeper including the solenoid thereof.

FIG. 3 shows the two pins 6 pivotally supporting keeper 5. It will be observed that the two wires **8*a*, 8*b* used for energizing solenoid 5*a* are threaded through one of pins 6 so that the wires do not need to be bent at each pivotal motion of keeper 5 and of its solenoid 5*a***.

Figure 4:
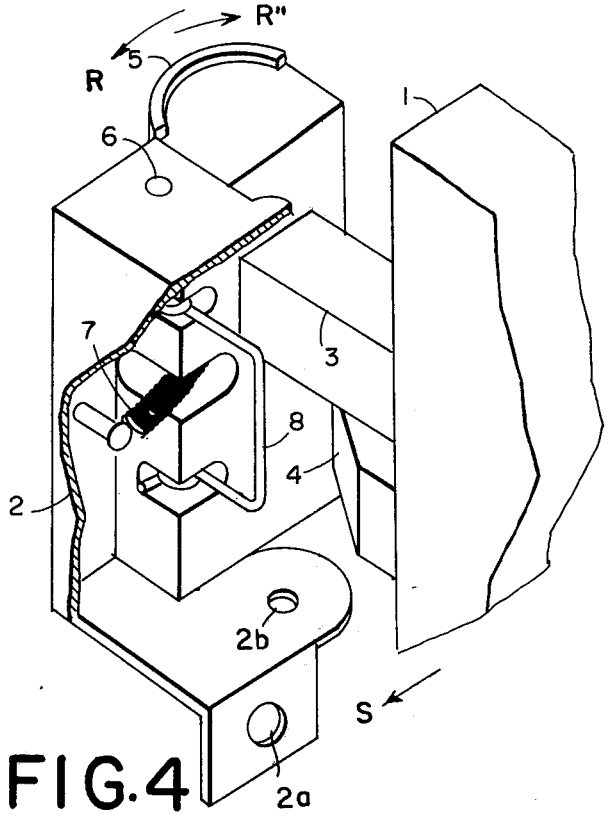
FIG. 4 is an isometric view of the entire assembly.

FIG. 4 shows the aforementioned parts but keeper 5 is open rather than closed.

As shown in FIG. 4, the keeper 5 has been pivoted in the sense of arrow R and is, therefore, in its open position wherein it is held by overcenter spring 7. The dead bolt 3 is in its extended position. When moved in the sense of arrow S it will hit upon abutment 8 and reclose the strike 2, which will then pivot in the direction indicated by arrow R″ to the closed position shown in FIGS. 1 and 2. Keeper 5 is under the action of over center spring 7. In the position shown in FIG. 4 keeper 5 is in its stable open position. As it is moved in the direction of arrow R″ it reaches an unstable position. Further movement in the closing direction of keeper 5 results in a reversal of the bias of spring 7 and hence in movement of the spring-biased keeper 5 to its closed position. FIG. 4 shows also the spring latch 4.

Figure 5:
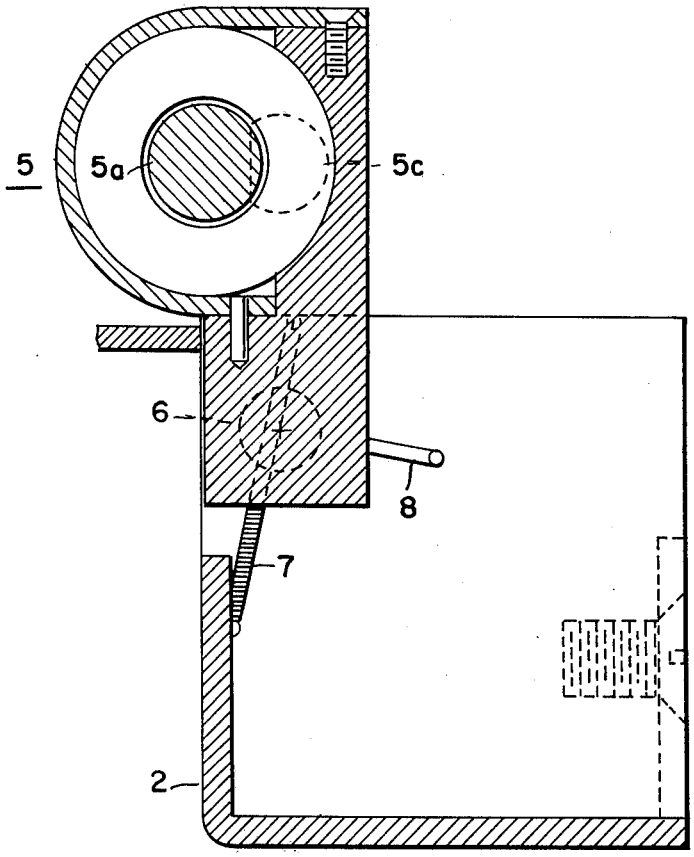
FIG. 5 shows the keeper and the strike case in top-plan view with the keeper in open position thereof.
Figure 6:
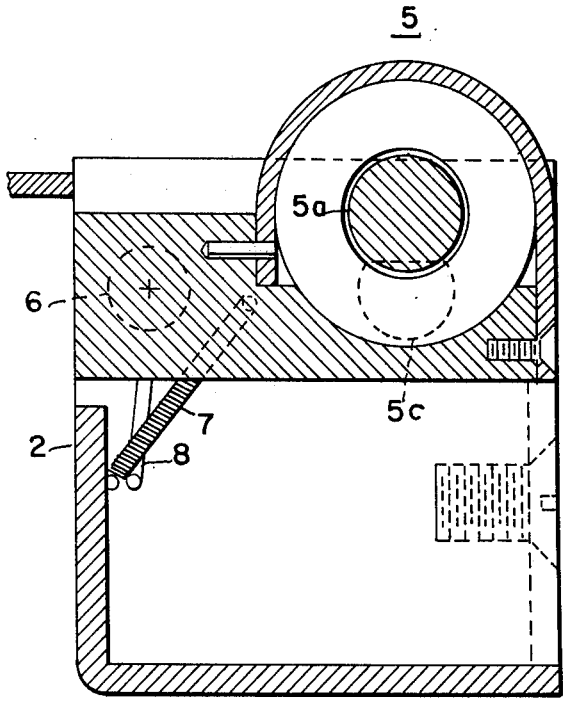
FIG. 6 shows the keeper and the strike case in top-plan view with the keeper in the closed position thereof.

FIGS. 5 and 6 show a portion of the above described mechanism but on a larger scale. FIG. 5 shows the keeper in the open position and FIG. 6 shows the keeper in the closed position. FIGS. 5 and 6 are self-explanatory since the same reference characters have been applied in these figures as in the figures previously described.

Figure 7:
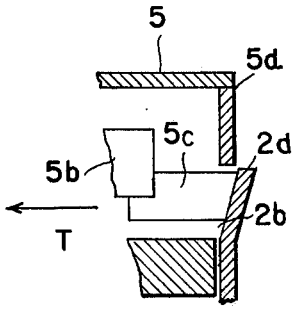
FIG. 7 shows some details of the keeper.

FIG. 7 shows a modification wherein the keeper 5 and its strike have overlapping joints indicated at **5*d* and latch bolt 5*c* is covered with a latch guard 2*d* which precludes insertion of a tool for driving latch 5*c*** in upward direction, i.e. in the direction of arrow T.

I claim as my invention:

1. A door locking mechanism including a. a strike case adapted to receive a dead bolt;

b. a pivotable keeper for selectively opening and closing said strike case;

c. bistable spring means acting on said keeper to maintain said keeper either in the fully open position or in the fully closed position thereof, said bistable spring means maintaining said keeper in said fully open position if the keeper is moved to its fully open position by the extended dead bolt;

d. an abutment projecting from said keeper and cooperating with said dead bolt to cause said bistable spring means to return said keeper to said fully closed position thereof if said dead bolt engages said abutment; and e. a latch bolt for maintaining said keeper in said fully closed position thereof when said bistable spring means has moved said keeper in closing direction.

2. A mechanism as specified in claim 1 wherein said abutment is formed by a spring frame projecting from said keeper.

3. A mechanism as specified in claim 1 including a spring latch, and a common strike case for receiving said spring latch and said dead bolt.

4. A mechanism as specified in claim 1 wherein said keeper includes a pivotally supported base portion, wires introduced in coaxial relation to the pivots of said base portion, and a solenoid portion for operating said latch bolt.

5. A mechanism as specified in claim 1 wherein said bistable spring means is a helical over-center spring having one end attached to said strike case, and having the other end attached to said keeper, said spring having an axis lying to different sides of the axis about which said keeper is pivoted when said keeper is in said fully closed and when said keeper is in said fully open position thereof.

6. A mechanism as specified in claim 1 wherein said keeper and said strike case have overlapping joints, and wherein said latch bolt is covered by a cavity guard.

7. A locking mechanism including a. a strike case adapted to receive a dead bolt;

b. a keeper having a pair of pivots for selectively opening and closing said strike case;

c. spring means for biasing said keeper to an open position and to a closed position;

d. a solenoid operated latch bolt inside said keeper;

e. a solenoid for operating said latch bolt inside said keeper; and f. a pair of wires for energizing said solenoid leading through one of the pivots of said keeper.

* * * * *